US012281471B2

(12) United States Patent
Torres et al.

(10) Patent No.: US 12,281,471 B2
(45) Date of Patent: Apr. 22, 2025

(54) PANEL WITH INSET GLASS

(71) Applicant: Haworth, Inc., Holland, MI (US)

(72) Inventors: Adrian A. Torres, Holland, MI (US); Kevin J. Welscott, Hamilton, MI (US); Alex J. Lamfers, Hudsonville, MI (US); Jason M. DeWeerd, Otsego, MI (US)

(73) Assignee: Haworth, Inc., Holland, MI (US)

( * ) Notice: Subject to any disclaimer, the term of this patent is extended or adjusted under 35 U.S.C. 154(b) by 169 days.

(21) Appl. No.: 18/147,288

(22) Filed: Dec. 28, 2022

(65) Prior Publication Data

US 2024/0218660 A1 Jul. 4, 2024

(51) Int. Cl.
*E04B 2/74* (2006.01)

(52) U.S. Cl.
CPC .... *E04B 2/7405* (2013.01); *E04B 2002/7487* (2013.01)

(58) Field of Classification Search
CPC ..... E04B 2/7405; E04B 2002/7487; A47B 83/001; E04F 11/181; E04F 11/1812; E04F 11/1853
See application file for complete search history.

(56) References Cited

U.S. PATENT DOCUMENTS 4,031,675 A * 6/1977 Roberts ..... E04B 2/7818 52/36.6
4,716,699 A * 1/1988 Crossman ..... E04B 2/7437 52/36.6
4,795,355 A * 1/1989 Dorn ..... H02G 5/04 439/115
4,870,793 A * 10/1989 Tomlinson ..... E04F 11/1853 52/241
5,689,924 A * 11/1997 Mason ..... E04B 2/7416 52/273
6,481,163 B1 11/2002 King et al.
6,748,710 B2 6/2004 Gresham et al.
6,772,890 B2 8/2004 Campbell et al.
6,807,776 B2 10/2004 Girdwood et al.
6,910,306 B2 * 6/2005 Waalkes ..... A47B 21/06 52/36.6
7,117,802 B2 10/2006 Hoke, Jr. et al.
7,461,484 B2 12/2008 Battey et al.
7,484,705 B2 2/2009 Hand et al.
7,574,833 B2 8/2009 Stark
7,603,821 B2 10/2009 Eberlein et al.
7,818,932 B2 10/2010 Eberlein et al.
(Continued)

*Primary Examiner* — Theodore V Adamos
(74) *Attorney, Agent, or Firm* — Warner Norcross + Judd LLP

(57) ABSTRACT

A panel construction includes a core having opposing surfaces, top and bottom edges, and first and second side edges. A surface material covers the first edge surface and extends to the top edge. A side edge material covers the first side edge and extends to the top edge. A top edge material covers the top edge and extends to the first side edge. A glass support notch extends through the top edge material and into the core. The notch extends through the first side edge of the core, and the side edge material on the first side edge covers the glass support notch on the first side edge. A channel rail is inserted into the glass support notch, and a glass panel is inserted into the channel rail, with a portion of the glass panel extending above the top edge material.

20 Claims, 12 Drawing Sheets

(56) References Cited

U.S. PATENT DOCUMENTS

| | | | | |
|---|---|---|---|---|
| 8,561,355 | B2 | 10/2013 | Canavarro | |
| 8,656,648 | B2 | 2/2014 | Liegeois et al. | |
| 8,826,621 | B2 | 9/2014 | Noble | |
| 8,844,210 | B2 | 9/2014 | Henriott | |
| 9,169,640 | B2 * | 10/2015 | Jeffers | E04B 2/7422 |
| 9,255,440 | B2 * | 2/2016 | Alexander | E04B 2/7425 |
| 9,380,867 | B2 | 7/2016 | Plikat et al. | |
| 9,427,083 | B2 | 8/2016 | Dame et al. | |
| 9,611,641 | B2 | 4/2017 | Hamilton et al. | |
| 9,752,327 | B2 * | 9/2017 | Poradzisz | E06B 3/5454 |
| 9,907,398 | B2 | 3/2018 | Dame et al. | |
| 10,989,237 | B1 | 4/2021 | Wittsche | |
| 11,371,542 | B2 | 6/2022 | Derelov | |
| 2003/0182871 | A1 * | 10/2003 | Gresham | A47B 83/001 52/36.1 |
| 2003/0183349 | A1 | 10/2003 | Gresham et al. | |
| 2004/0250480 | A1 | 12/2004 | Matthai | |
| 2006/0277834 | A1 * | 12/2006 | Roh | E04B 2/7424 52/36.1 |
| 2021/0396352 | A1 | 12/2021 | Del Favero | |
| 2022/0010552 | A1 | 1/2022 | Barkman et al. | |
| 2022/0056937 | A1 | 2/2022 | Lyons et al. | |

* cited by examiner

PANEL WITH INSET GLASS

BACKGROUND OF THE INVENTION

The present invention relates to a panel construction, such as a modular panel construction for creating a workspace. Modular panels are well known for use in defining workspaces. These panels generally have front and rear panel surfaces that are provided with an aesthetically pleasing finish, and side edges that can be connected to similar panels in an in-line or corner configuration to define one or more adjacent private or semi-private workspaces. In many cases, these panels have an interior structural frame that is covered on each side by a decorative panel cover. Other panels have a wood core, such as solid wood or wood fiber, and may be provided with decorative veneer or laminate layers on the front and rear surfaces.

It is also common to attach accessories to panels with interior frames. These interior frames can be formed with slots, hooks, and channels for the insertion and attachment of screens, shelves, worksurfaces and the like. One relatively well known accessory for attaching to an interior frame is a glass panel extending upwardly from the top rail of the frame. These glass panels provide a visually pleasing top portion of the workspace. They can be frosted or tinted to provide a degree of privacy while still allowing light into the workspace. The top rail of the frame can be formed with clips or a channel for receiving a portion of the glass panel in an upright position at the top of the panel.

It can be more difficult to attach accessories to panels with a wood core or other panels that do not have a structure interior frame. In particular, it can be difficult to attach accessories such as glass panels to the top of a wood core because it requires drilling or cutting into the core, which can damage the structural integrity of the core itself. Attempts have been made to attach clips to the upper edge of the core, but these are generally unsightly. Other attempts have been made to cut a channel in the upper edge of the core, such that the glass can be inset into the channel, but these attempts have created difficulty in that the channel cannot be extended to the side edges of the core without impacting the structural integrity. As a result, the glass does not extend to the side edges—leaving unsightly gaps between the glass panels of adjacent modular panels. Manufacturers continue to seek cost effective methods for providing accessories on solid core panels.

SUMMARY OF THE INVENTION

The present invention provides a panel construction with a glass panel that is inset into the top edge of a core in such a way as to minimize manufacturing costs while creating a favorable aesthetic by reducing the gap between the glass panel and adjacent panels.

In one embodiment, the panel construction includes a core having first and second opposing surfaces, top and bottom edges, and first and second side edges. A surface material covers the first edge surface and extends to the top edge. A side edge material covers the first side edge and extends to the top edge. A top edge material covers the top edge and extends to the first side edge. A glass support notch is cut through the top edge material and into the top edge of the core. The notch is cut such that it extends through the first side edge of the core, and the side edge material on the first side edge covers the glass support notch on the first side edge. A channel rail is inserted into the glass support notch, and a glass panel is inserted into the channel rail between the sidewalls of the channel, with a portion of the glass panel extending above the top edge material.

In one embodiment, the core is formed from a wood fiber material, the top edge material is a plastic edge band material, and the surface material is a decorative laminate. The glass support notch may also extend through second side edge, with the side edge material on the second side edge covering the glass support notch on the second side edge. The support notch may extend continuously from the first side edge to the second side edge at a uniform depths.

The channel rail may be a U-shaped metal channel that is formed from a single material and is inserted into the notch between the sidewalls of the notch with the floor of the channel positioned on the floor of the notch, and a plurality of retention clips may be inserted into the channel rail between the channel rail sidewalls, with each of the clips including a pair of clip arms, and with the glass panel inserted between the clip arms and held in place by the clip arms.

The glass panel includes a bottom edge, a top edge, and first and second side edges. In one embodiment, the side edge material includes an inner surface and an outer surface, and the first side edge of the glass panel faces and is adjacent to the inner surface of the side edge material. And in one embodiment, a second one of the panel constructions is positioned adjacent to the panel construction, with the side edge material defining a thickness, and wherein the first side edge of the glass panel of the panel construction is spaced from the second panel construction by the thickness of the first side edge material. Such a construction may reduce the gap between the glass panel of the panel construction and the glass panel of the second panel construction.

In one embodiment, the invention includes a method for manufacturing a panel construction with inset glass. The method includes the steps of: providing a core having first and second opposing surfaces, a top edge, a bottom edge, and first and second side edges; providing a first surface material on the first surface, including extending the first surface material to the top edge of the first surface; providing a top edge material on the top edge; cutting a glass panel support notch in the top edge by cutting through the top edge material, the glass panel support notch extending through the first side edge of the core and forming a first notch opening in the first side edge of the core; providing a first side edge material on the first side edge of the core, the first side edge material covering the first notch opening; inserting a channel rail into the glass panel support notch, the channel rail including a floor and a pair of upwardly extending sidewalls; and inserting a glass panel into the channel rail between the sidewalls of the channel rail, the glass panel including a bottom panel edge positioned within the channel rail and below the top edge of the core, the glass panel including a top edge opposite the bottom edge, the top edge of the glass panel extending outwardly beyond the top edge of the core. The glass panel may include a first side edge that is adjacent to and directly faces the first side edge material.

The method may include the step of inserting a plurality of retention clips into the channel rail between the sidewalls, each of the retention clips having a pair of clip arms. The glass panel may be inserted between the clip arms of the retention clips. The first side edge material may be provided after the cutting of the glass panel support notch.

In one embodiment, a second one of the panel constructions is provided in an in-line arrangement with the panel construction, wherein the first side edge material of the second panel construction directly faces the first side edge material of the panel construction. The first side edge material of the panel construction may abut the first side edge material of the second panel construction.

In another embodiment, a second one of the panel constructions is provided in an L-shaped arrangement with the panel construction, wherein the first side edge material of the panel construction directly faces the first surface material of the second panel construction. The first side edge material of the panel construction may abut the first surface material of the second panel construction.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and may be practiced or may be carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENT

Figure 1:
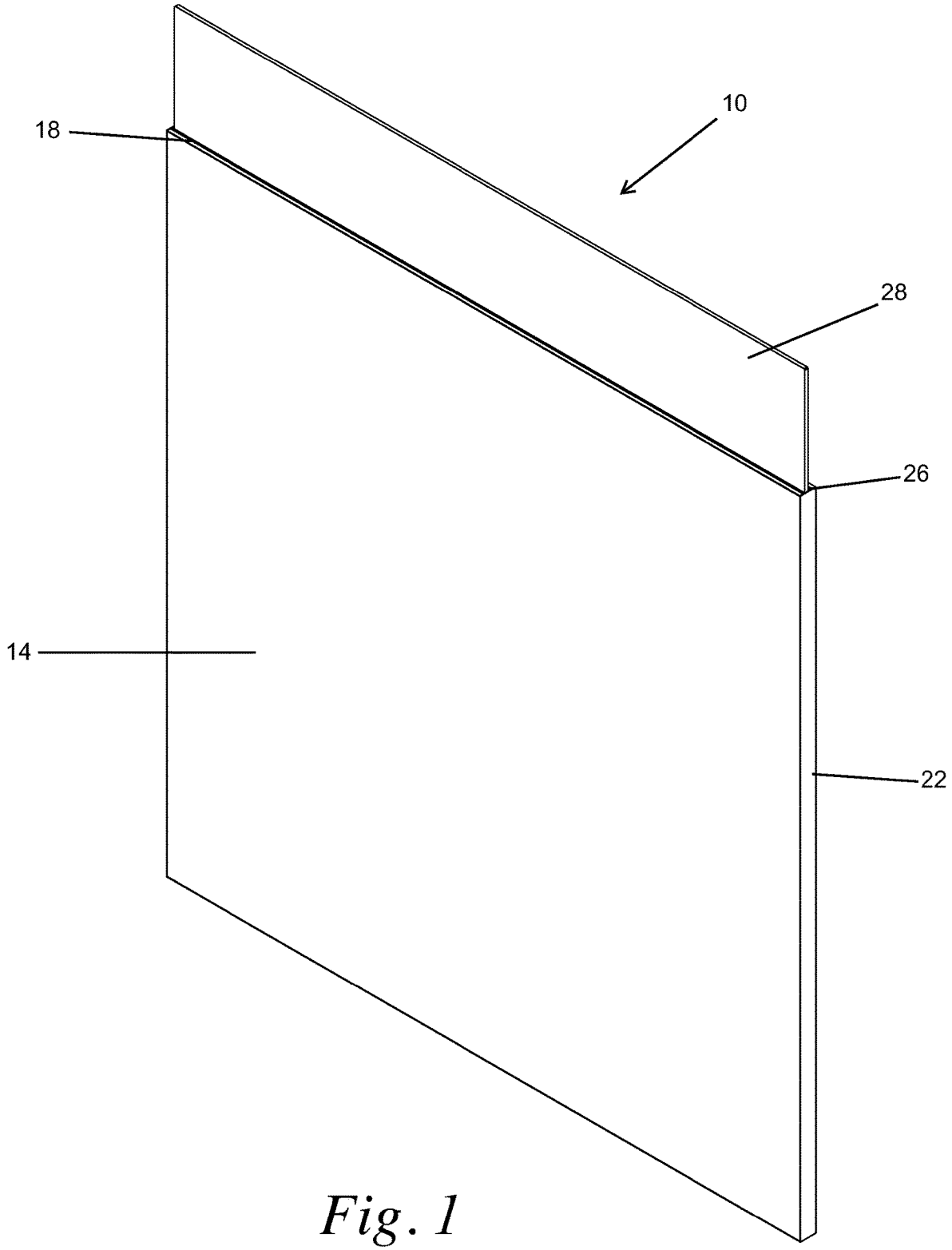
FIG. 1 is a perspective view of a panel construction according to one embodiment of the present invention.

A panel construction according to one embodiment of the present invention is shown in FIG. 1 and generally designated 10. In one embodiment, the panel construction 10 includes a core 12, first and second surface covering materials 14, 16, top and bottom edge cover materials 18, 20, and left and right side edge cover materials 22, 24. A glass panel support notch 26 is defined in the core 12, and a glass panel 28 is inserted into the notch 26 and extending upwardly from the notch 26.

In one embodiment, the core 12 includes a front surface 30, a rear surface 32 opposite the front surface 30, a bottom edge 34, a top edge 36, and left and right side edges 38, 40. The core 12 may have a variety of shapes, and in the illustrated embodiment has the shape of a rectangular upright panel wherein the front 30 and rear 32 surfaces form major surfaces of the core 12 and the bottom 34, top 36, and side edges 38, 40 form relatively narrow edges of the core 12. The thickness and length of these edges, and the overall size of the core 12, may be varied depending on the application, and are generally sized to form an office privacy panel. The core 12 may be made from a variety of materials, and is generally formed from a wood material such as pressed wood fibers. For example, the core 12 may be formed from a wood based board such as a medium density fiberboard (MDF) or a high density fiberboard (HDF) which include wood particles or fibers pressed together with an adhesive to take the shape of a solid panel. In another embodiment, the core 12 may be formed from solid wood, an alternative wood product, or an alternative material such as plastic.

The surface covering materials 14, 16 generally cover the front 30 and rear 32 surfaces of the core 12. In the illustrated embodiment, the surface covering materials are a thin layer that is adhered or otherwise attached to the core 12. The surface covering materials 14, 16 be formed from a wood veneer, or a laminate, such as an HPL (High Pressure Laminate) and may have a top layer consisting of one or more prints and/or one or more layers of lacquer, such as primers, decorative paint layers, transparent top layers, a wood grain appearance and the like. In the illustrated embodiment, these materials 14, 16 extend to bottom 34, top 36, and side edges 38, 40 to substantially cover all of the front 30 and rear 32 surfaces. In another embodiment, these layers may cover only a portion of the front 30 and rear 32 surfaces.

The top 18, bottom 20, and side 22, 24 edge materials may form layers that cover the bottom 34, top 36, and side 38, 40 edges of the core 12. These layers may be adhered or otherwise attached to the core 12. In one embodiment, these edge materials 18, 20, 22 and 24 are all formed of the same material, such as an ABS strip (synthetic material strip of acrylonitrile butadiene styrene), another type of plastic strip, or a laminate. In another embodiment, the side edge materials may be formed of other materials, such as a thin wood layer, or another thin layer of material that can protect the core 12. These side edge layers are generally formed of a damage resistant material. They may match the appearance of the front 14 and rear 16 surface materials, or they may be different from the surface materials. In the illustrated embodiment, each of the edge materials 18, 20, 22 and 24 are sized—at least initially—to cover substantially all of their respective edges 34, 36, 38, 40.

Figure 2A:
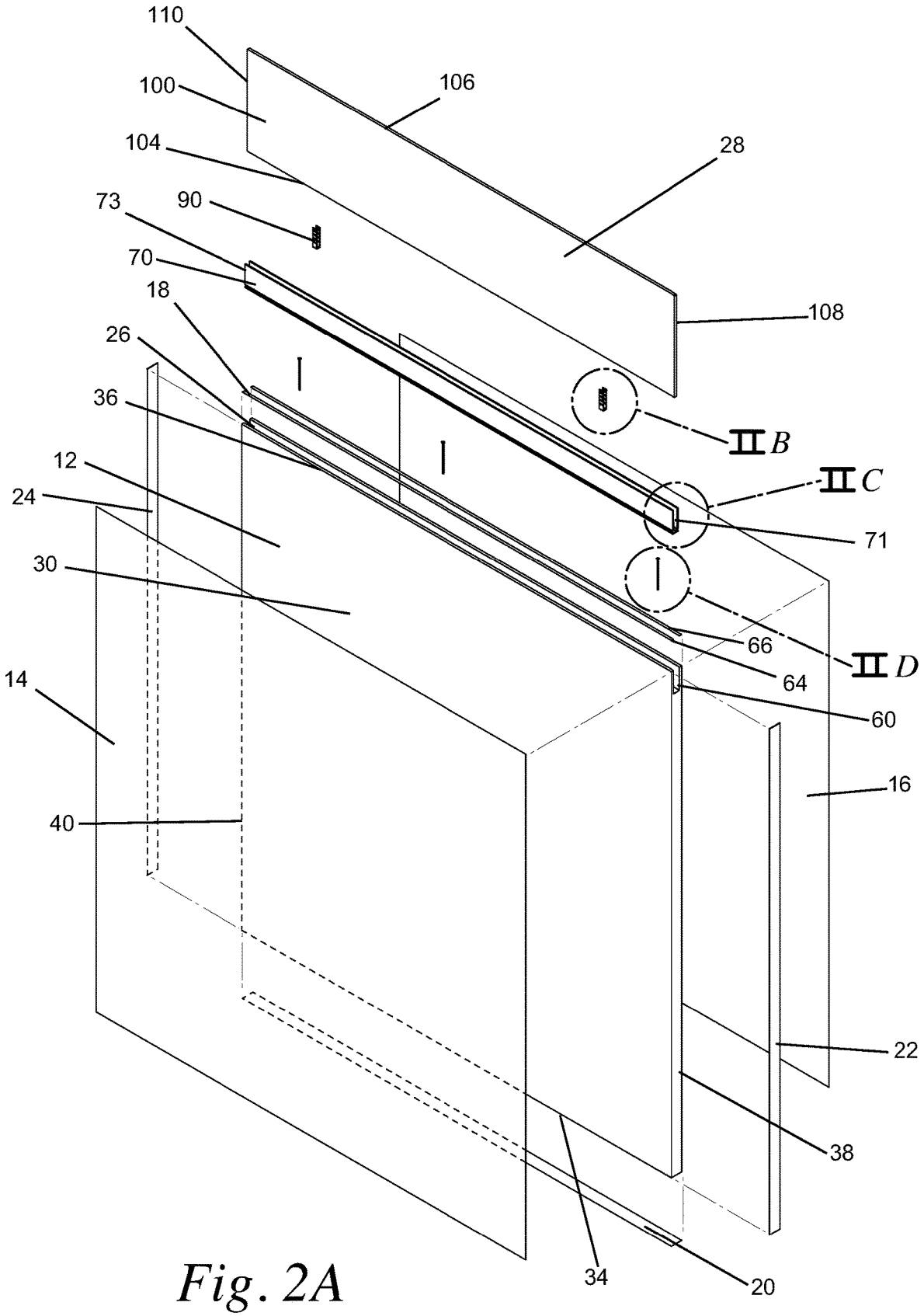
FIG. 2A is an exploded view thereof.
Figure 3:
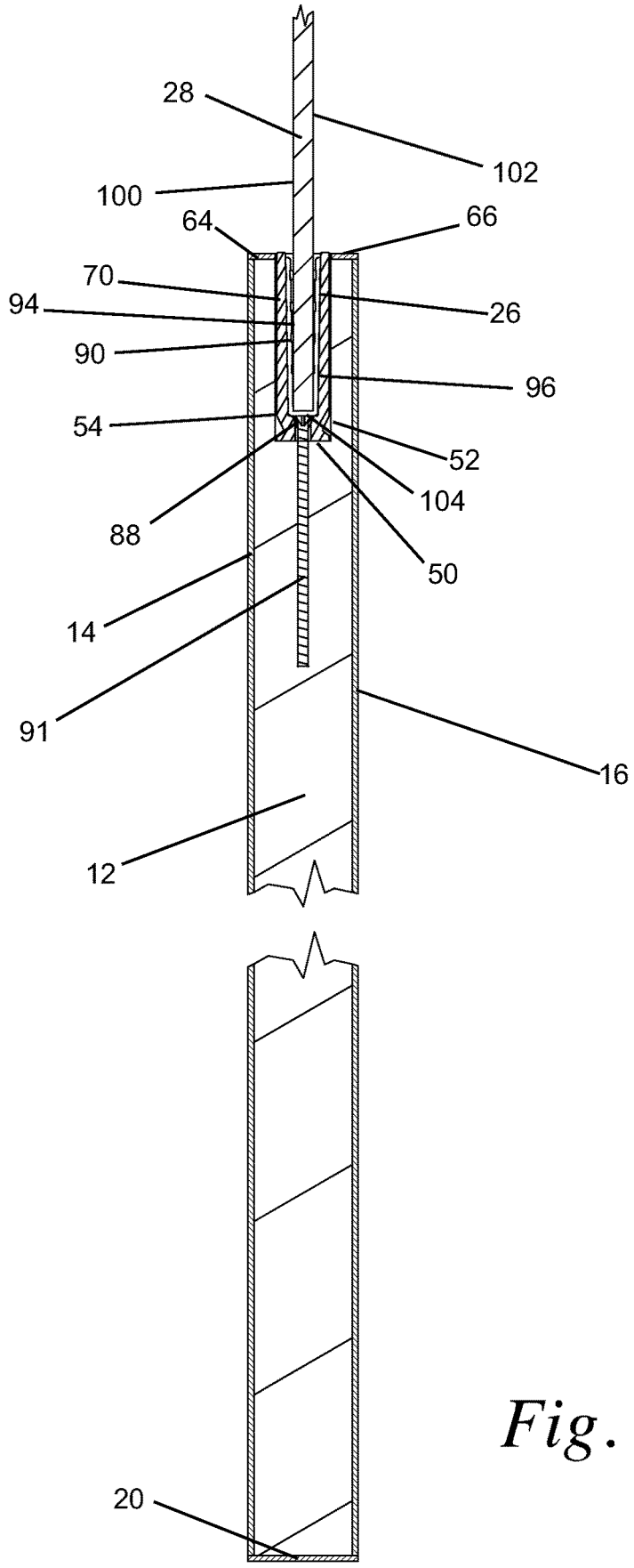
FIG. 3 is a side cross sectional view of a panel construction according to one embodiment of the present invention.
Figure 4:
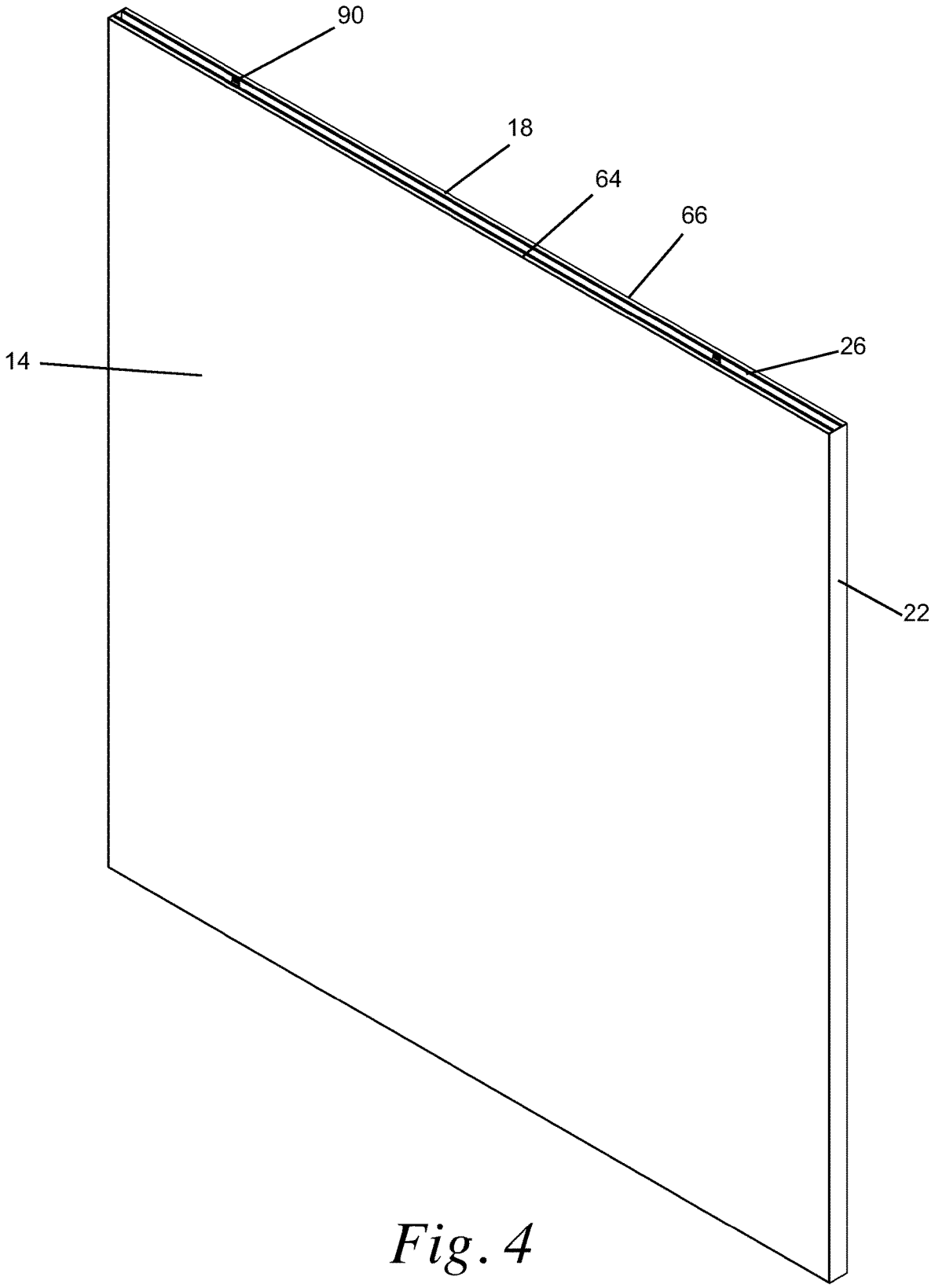
FIG. 4 is a perspective view of a panel construction with the glass panel removed.
Figure 5:
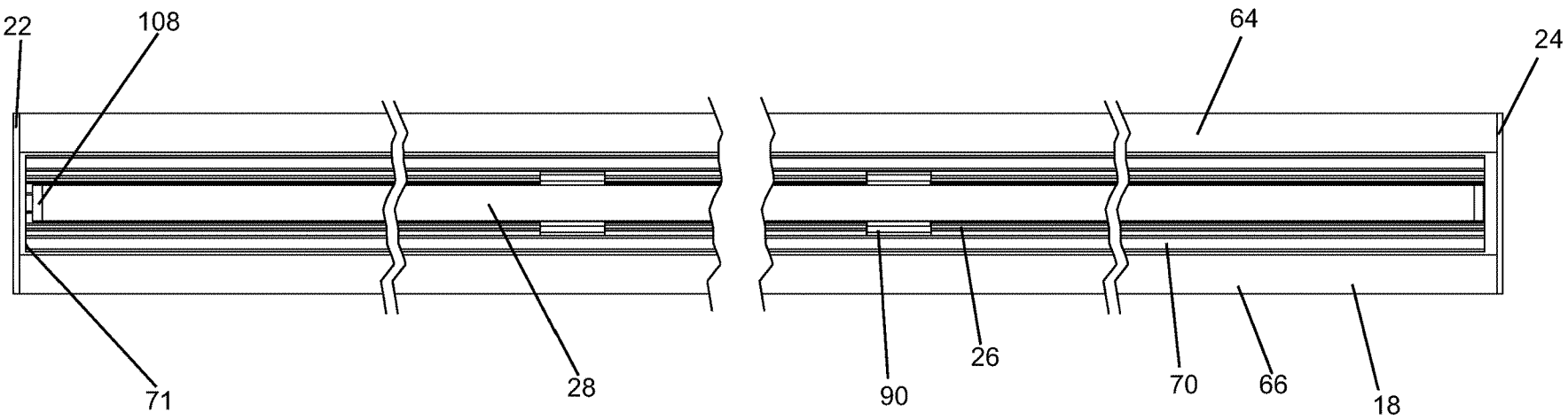
FIG. 5 is a top view of the panel construction according to one embodiment.
Figure 6:
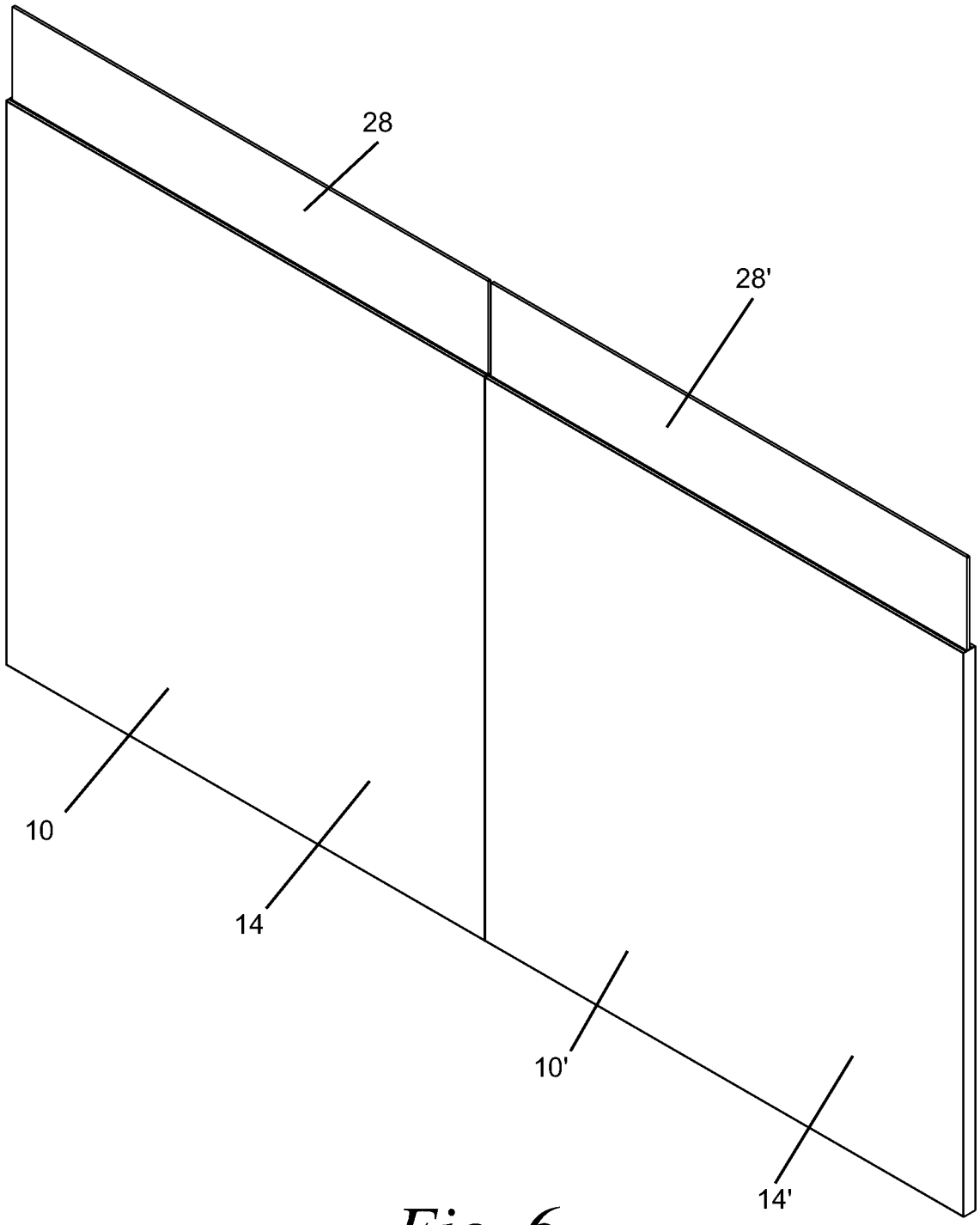
FIG. 6 is a perspective view of two panel constructions in an in-line arrangement.

Referring to FIGS. 2A, 3 and 4, the glass panel support notch 26 is formed into the core 12 for the purpose of supporting an inset portion of the glass panel 28, or another type of accessory inserted into the notch 26. In the illustrated embodiment, the glass panel support notch 26 is formed in the top edge 36 of the core 12 and extends a desired distance into the core 12 sufficient to support the type of glass panel 28 or other accessory. In one embodiment, the notch 26 has a floor 50, and a pair of opposing notch sidewalls 52, 54 that are spaced apart to form a notch width that corresponds to the thickness of the glass panel 28. As shown, the notch 26 has a uniform depth and a uniform thickness extending across the core 12 from the first side edge 38 to the second side edge 40. Also as shown, the notch 26 extends continuously and completely through both of the side edges 38, 40 to form notch openings 60 in the side edges 38, 40. In an alternative embodiment, the notch 26 may have a variable thickness and depth, and may extend through only one of the side edges 38, 40.

According to one embodiment, the glass panel support notch 26 is formed by cutting through the top edge material 18. As noted in more detail below, this cut may be formed by a variety of cutting methods. After cutting, the top edge material 18 includes a first top edge portion 64 on a first side of the notch 26 and a second top edge portion 66 on the opposite side of the notch 26. In one embodiment, the notch 26 is cut such that the first 64 and second 66 top edge portions are the same size, although in one embodiment the notch 26 may be closer to the front 30 or rear 32 surface of the core 12, such that one of the top edge portions 64, 66 is wider than the other.

Figure 2B:
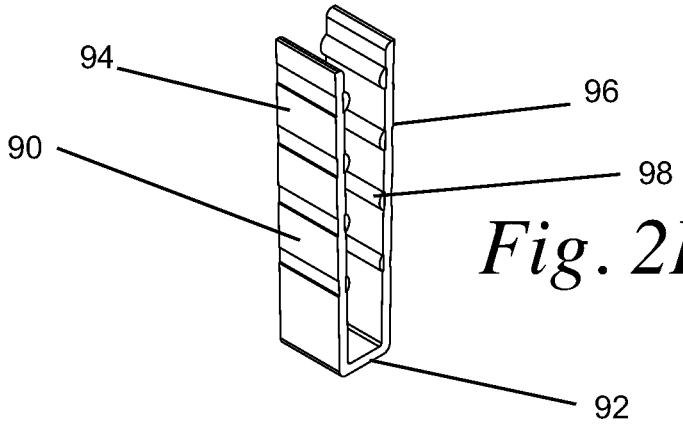
FIG. 2B is a close up view of the portion circled at IIB in FIG. 2A.
Figure 2C:
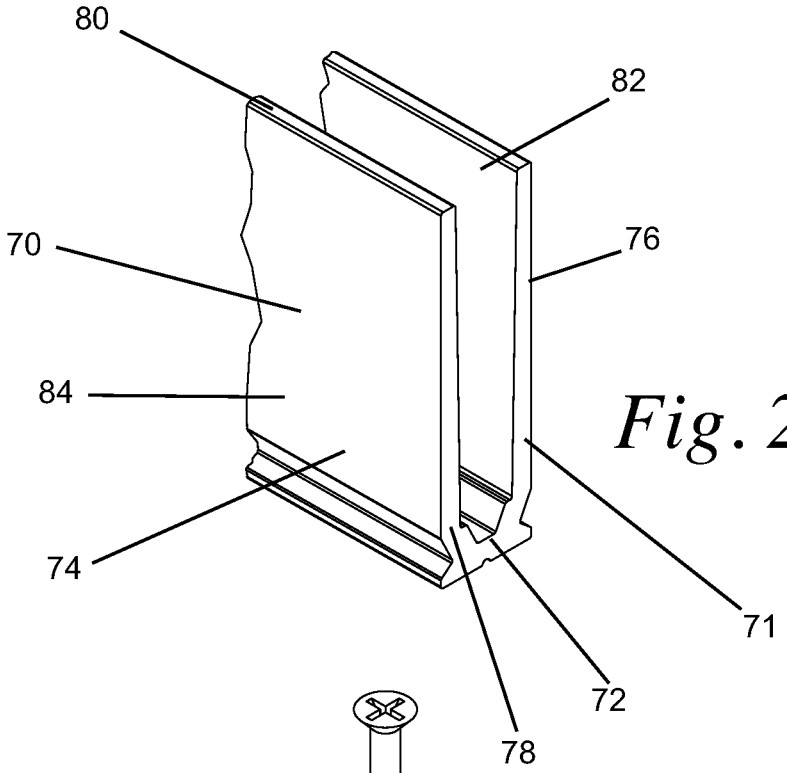
FIG. 2C is a close up view of the portion circled at IIC in FIG. 2A.
Figure 2D:
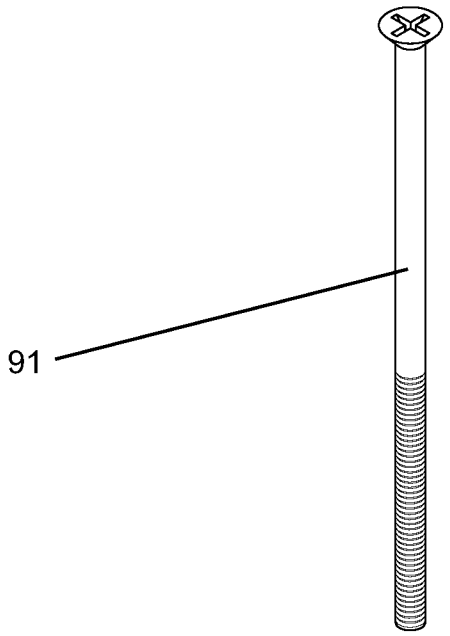
FIG. 2D is a close up view of the portion circled at IID in FIG. 2A.

In one embodiment, the panel construction includes a channel support rail 70. The channel support rail 70 may be a structural support rail that is positioned within the notch 26 to provide structural support for the glass panel 28. Referring to FIGS. 2A, 2C and 3, the channel support rail 70 may be a U-shaped member formed of a rigid material such as extruded aluminum having longitudinal ends 71, 73. As shown, the channel support rail 70 includes a floor or bottom wall 72, and a pair of sidewalls 74, 76 extending upwardly form the bottom wall 72. Each sidewall includes a base 78 at the junction with the bottom wall 72, and a rim 80 opposite the base 78. Each sidewall additionally includes an interior surface 82 facing the opposing sidewall and an exterior surface 84 opposite the interior surface 82. The bottom wall 72 may define one or holes 88 for receiving a fastener 91, such as a threaded screw or the like.

The channel support rail 70 is inserted into the glass panel support notch 26 and attached within the notch 26. In one embodiment, the channel support rail 70 is sized to fit closely within the notch 26, such that the bottom wall 72 sits on the floor 50 of the notch 26, and the exterior surfaces 84 of the sidewalls 74, 76 are adjacent to, and may in some applications abut, the walls of the notch 52, 54. The length of the channel support rail 70 between the longitudinal ends 71, 73 may be sized to correspond closely to the length of the core 12, such that the ends 71, 73 are each adjacent to one of the side edges 38, 40 of the core 12. In one embodiment, the channel support rail 70 may be attached to the core 12 within the notch 26 by the fastener(s) 91 by inserting the fastener(s) through the holes 88 and into the core 12. In an alternative embodiment, the channel support rail 70 may be formed of a different material, or combination of materials, including a plastic or another metal, or another generally rigid material. In another embodiment, the channel rail 70 may have a different cross-sectional shape, or may include two separate pieces inserted into the notch 26 and forming the sidewalls 74, 76.

The panel construction may additionally include one or more retainer clips 90 for assisting in the retention of the glass panel 28. With reference to FIGS. 2A and 2B, these clips may be U-shaped clips 90 having a clip floor 92, and a pair of spaced apart clip arms 94, 96 extending from the clip floor 92. The retainer clips 90 may be sized for tight insertion into the channel rail 70, between the sidewalls 74, 76 of the channel rail 70. In one embodiment, each of the clips 90 includes a series of grip features 98 protruding inwardly from the clip arms 94, 96. The clips 90 may be made from a resilient material, such as a thermoplastic elastomer, or from a metal such as spring steel with a resilient quality. In one embodiment, a series of the clips 90 are inserted into the channel rail 70 in spaced relation to one another along the length of the channel rail 70.

The glass panel 28 is inserted into the glass panel support notch 26, the channel rail 70 and the clips 90 to inset a portion of the glass panel 26 and form the panel construction 10. In one embodiment, the glass panel 28 is a generally conventional glass panel 28 having a front surface 100, rear surface 102 opposite the front surface 100, a bottom edge 104, a top edge 106, and longitudinal ends 108, 110. In the illustrated embodiment, the thickness of the glass panel 28, between the front 100 and rear 102 surfaces, generally correspondence to the distance between the sidewalls 74, 76 of the channel rail 70 and between the retainer clip arms 94, 96, such that the glass panel 28 can be inserted into the channel rail 70 and with the front surface 100 contacting one of the clip arms 94 and the rear surface 102 contacting the other clip arm 96. The clip arms 94, 96 may act on the glass panel 28 to retain the glass panel 28 and hold the glass panel 28 in a vertical position. The bottom edge 104 is shaped to match the shape of the channel rail bottom wall 72, and in the illustrated embodiment is generally straight. The top edge 106 may also be generally straight, and as shown is parallel to the bottom edge 104, although the top edge 106 may otherwise have a decorative shape. The longitudinal ends 108, 110 may be straight, and may be parallel to form a rectangular shaped glass panel 28.

The glass panel 28 is inset into the channel rail 70, between the sidewalls 74, 76 of the channel rail 70. In an embodiment including the clips 90, the glass panel 28 is inserted into the channel rail 70 between the clip arms 94, 96 of any clips 90 that are positioned within the channel rail 70. The glass panel 28 may be inserted with the bottom edge 104 of the glass panel 28 abutting the clip floor 92 and the front 100 and rear 102 surfaces of the glass panel 28 contacting the clip arms 94, 96. As a result of the clips 90 and channel rail 70 positioned in the glass panel support notch 26, the bottom edge 104 of the glass panel 28 and a portion of the glass panel 28 adjacent to the bottom edge 104 are inset below the top edge 36 of the core 12 and within the notch 26. The longitudinal ends 108, 110 of the glass panel 28 may extend to the side edges 38, 40 of the core 12 to be adjacent to and directly facing the side edge materials 22, 24. Additional fasteners, spacer rails or adhesives may be used and inserted into the notch to retain the glass panel 28 within the notch 26 and form the panel construction 10.

Figure 7:
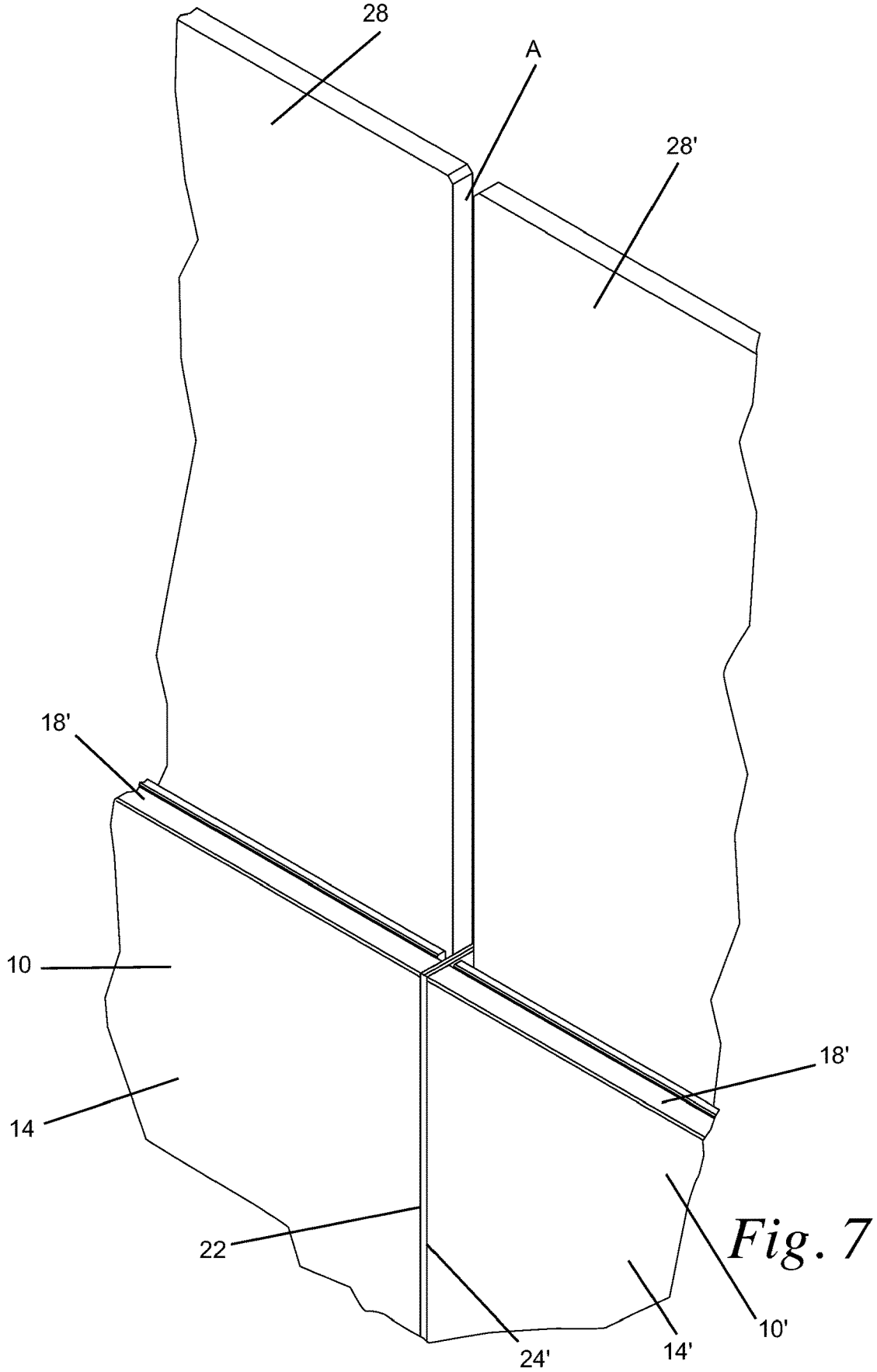
FIG. 7 is a close up view of the panel constructions of FIG. 6.

FIGS. 6-11 show variations of a panel construction 10 according to the present invention arranged adjacent to a second one of the panel constructions 10' to form a wall or a partial enclosure for a workspace or the like. In the arrangement shown in FIGS. 6 and 7, the first panel construction 10 and a second panel construction 10' are positioned adjacent to each other in an inline arrangement, with the front surface material 14 of the first panel construction 10 coplanar with the front surface material 14' of the second panel construction 10' and with a side edge material 22 of the first panel construction 10 abutting the side edge material 24' of the second panel construction 10'. With reference to FIG. 7, in this arrangement of the panel constructions 10, 10', the gap A between adjacent glass panels 28, 28' is determined by the thickness of the edge materials 22, 24', which enables the adjacent longitudinal ends 108, 110' of the glass panels 28, 28' to be closely spaced with each other.

Figure 8:
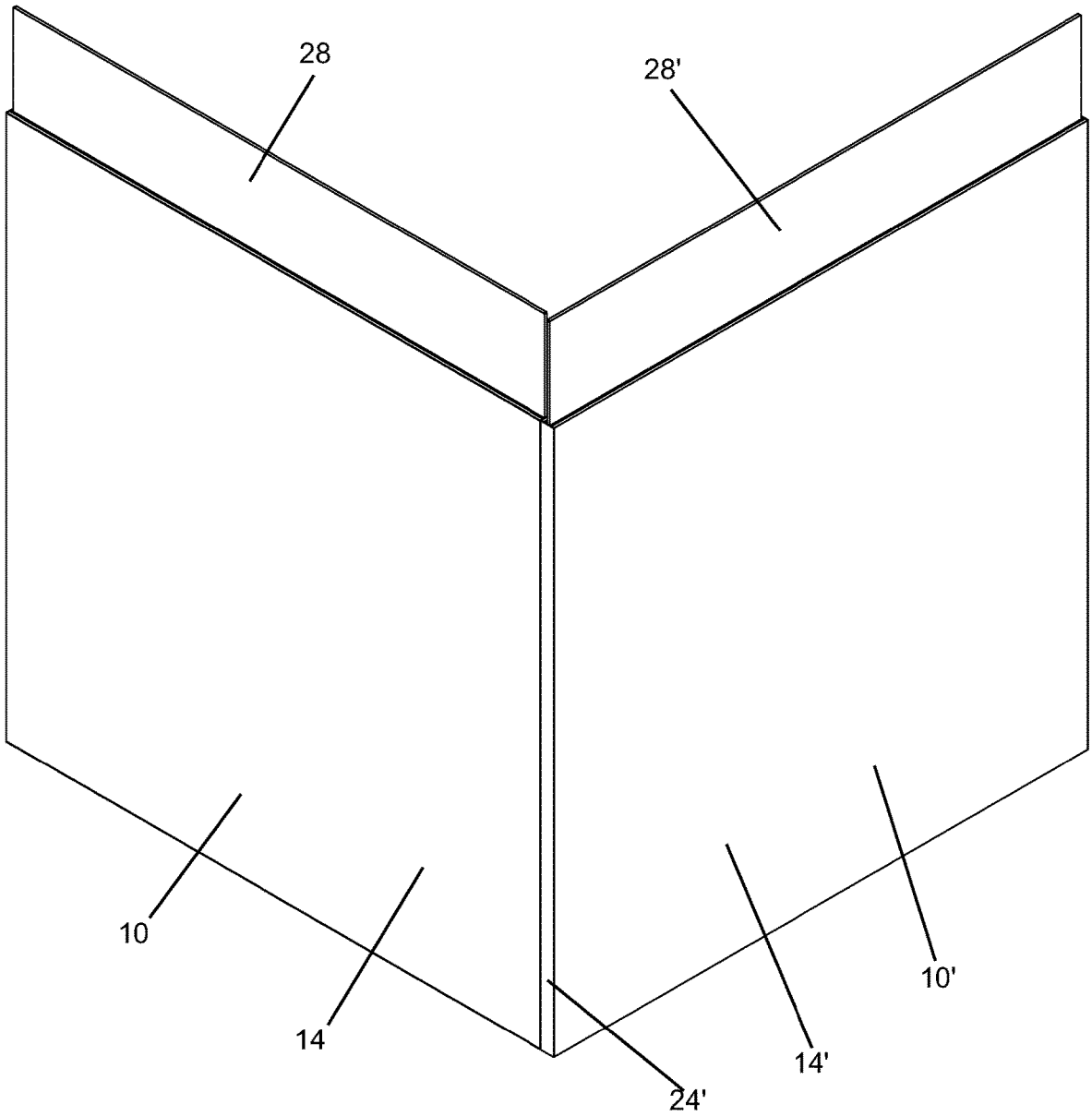
FIG. 8 is a perspective view of two panel constructions in an L-shaped arrangement.
Figure 9:
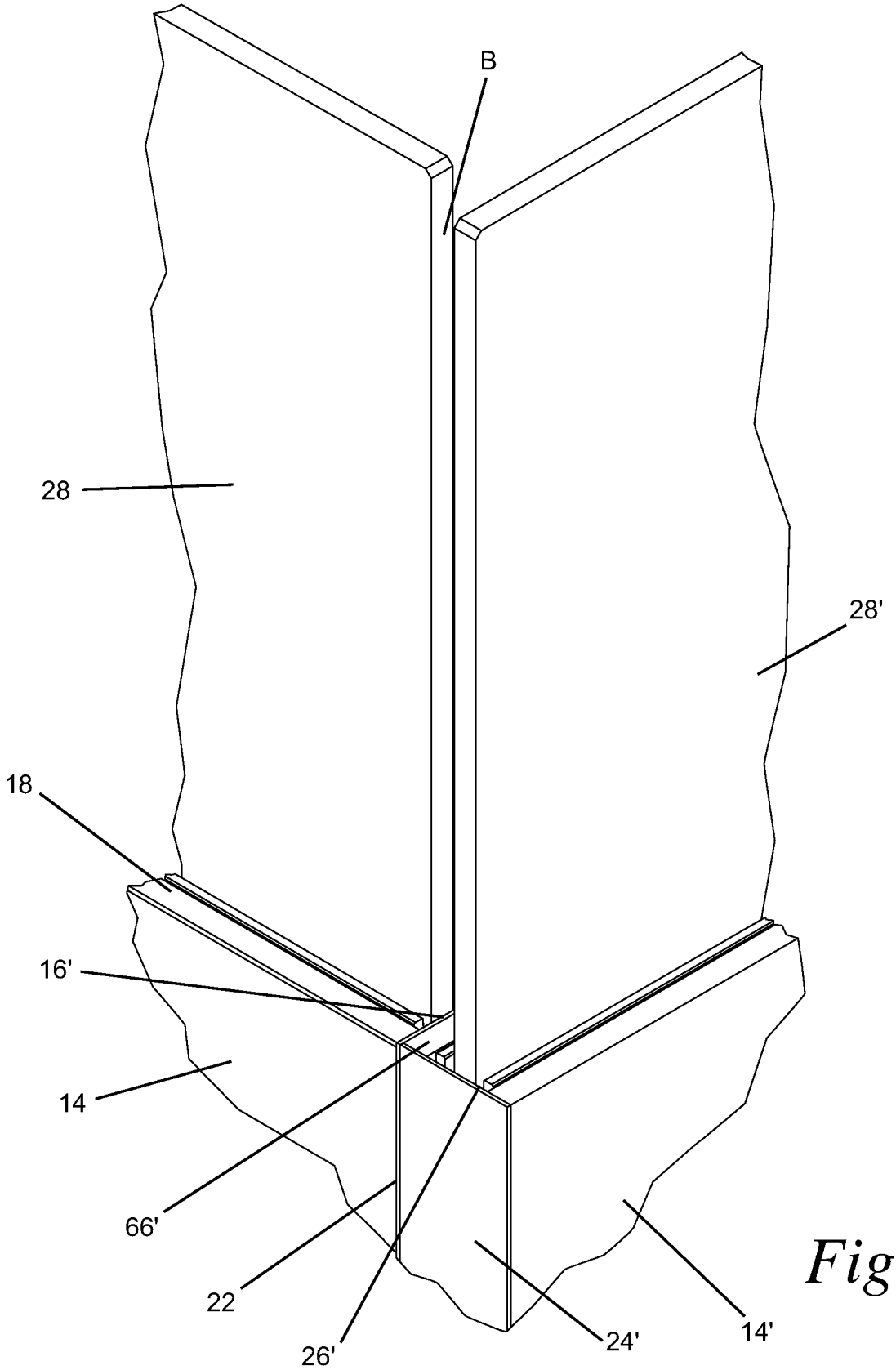
FIG. 9 is a close up view of the panel constructions of FIG. 8.
Figure 10:
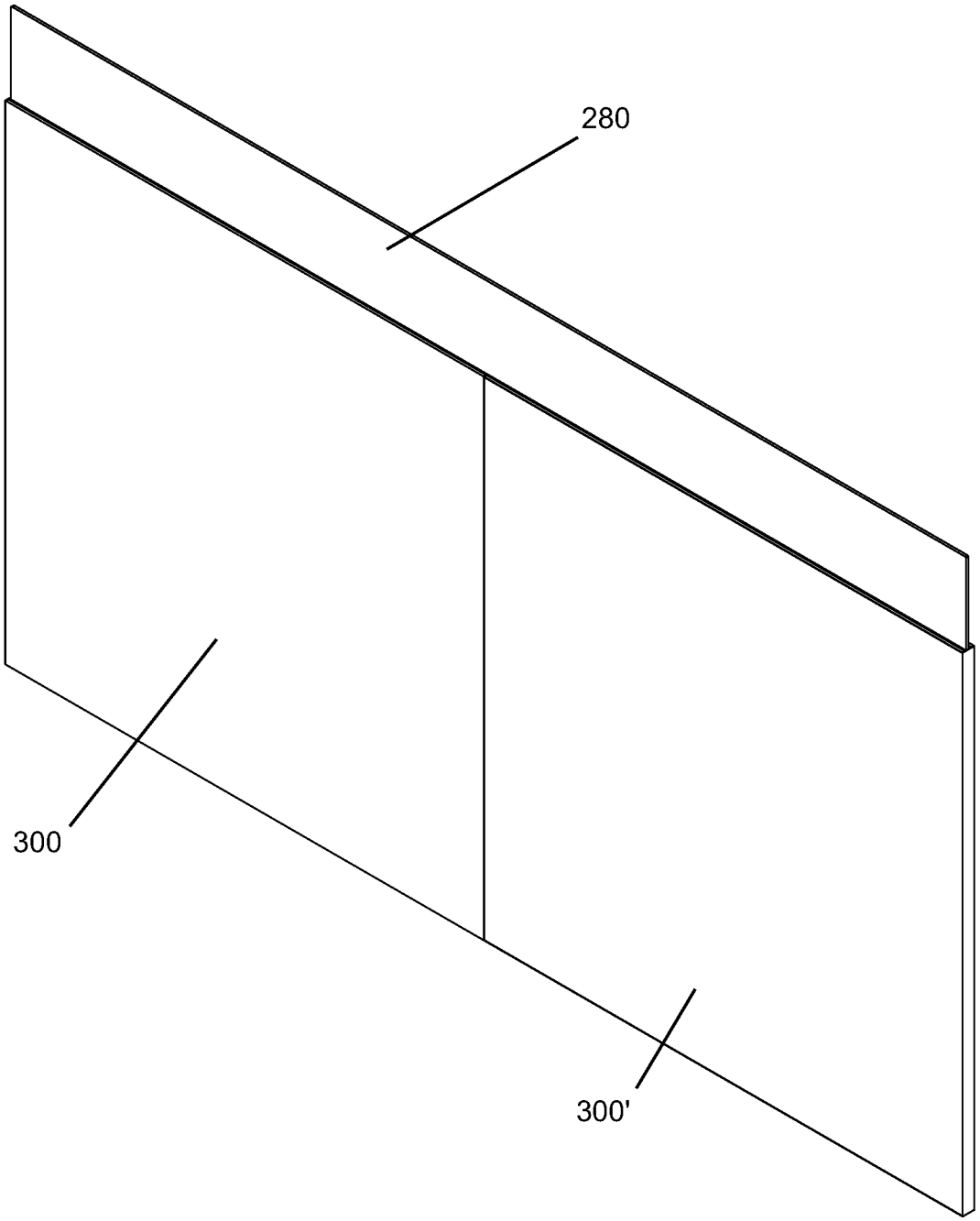
FIG. 10 is a perspective view of an alternative embodiment with a glass panel spanning two panel constructions.
Figure 11:
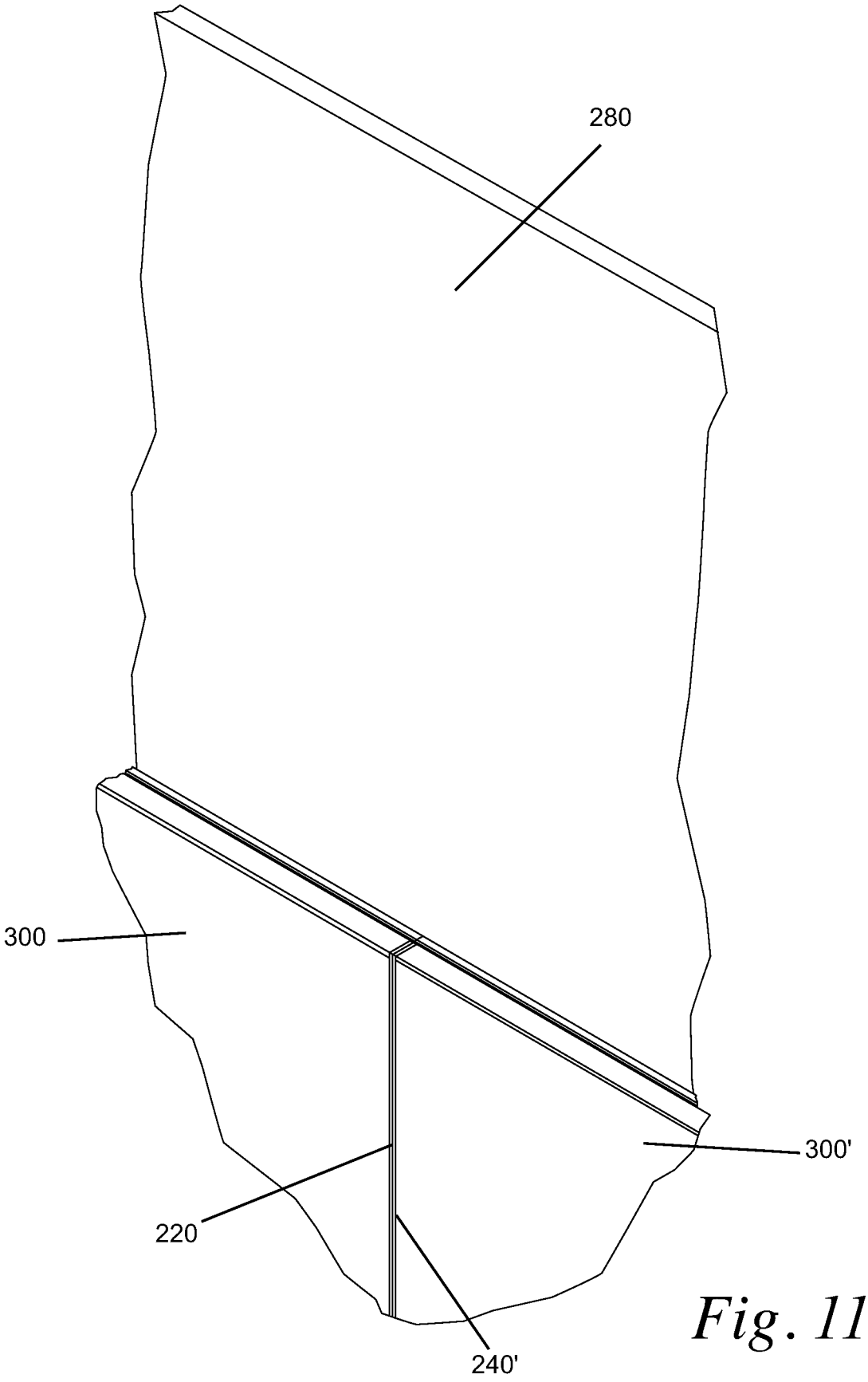
FIG. 11 is a close up view of the alternative embodiment of FIG. 10.

In the arrangement shown in FIGS. 8 and 9, the first panel construction 10 and a second panel construction 10' are positioned adjacent to each other in an L-shaped or corner configuration, with the front surface material 14 of the first panel construction forming a 90-degree angle with the front surface material 14' of the second panel construction 10' and with a side edge material 22 of the first panel construction 10 abutting the rear surface material 16' of the second panel construction 10'. With reference to FIG. 9, in this arrangement of the panel constructions 10, 10', the gap B between adjacent glass panels 28, 28' is determined by the thickness of one of the edge materials 22 of the first panel construction 10 and the thickness of the core 12 and the rear surface material 16' on one side of the notch 26' in the second panel construction 10'. The arrangement shown in FIGS. 10 and 11 depicts an alternative embodiment wherein a single glass panel 280 spans two adjacent panel constructions 300, 300'. In this arrangement, the adjacent side edge panels 220, 240' between the two panel constructions 300, 300' may be removed or may include notches (not shown) to enable the glass panel 280 to span the two panel constructions 300, 300'.

The present invention also includes a method for forming a panel construction 10. In one embodiment, the method includes the steps of: (1) providing a core 12 having first and second opposing surfaces 30, 32, a top edge 36, a bottom edge 34, and first and second side edges 38, 40; (2) providing a first surface material 14 on the first surface 30, including extending the first surface material 14 to the top edge 36 of the first surface 30; (3) providing a top edge material 18 on the top edge 36; (4) cutting a glass panel support notch 26 in the top edge 36 by cutting through the top edge material 18, the glass panel support notch 26 extending through the first side edge 38 of the core and forming a first notch opening 60 in the first side edge 38 of the core 12; (5) providing a first side edge material 22 on the first side edge 38 of the core 12, the first side edge material 22 covering the first notch opening 60; (6) inserting a channel support rail 70 into the glass panel support notch 26, the channel support rail 70 including a floor 72 and a pair of upwardly extending sidewalls 74, 76; and (7) inserting a glass panel 28 into the channel rail 70 between the sidewalls 74, 76 of the channel rail 70, the glass panel 28 including a bottom panel edge 104 positioned within the channel rail 70 and below the top edge 36 of the core 12, the glass panel 28 including a top edge 106 opposite the bottom edge 104, the top edge 106 of the glass panel 28 extending outwardly beyond the channel rail 70 and the top edge 36 of the core 12. In one embodiment, the glass panel 28 includes a first side edge 108 that is adjacent to and directly faces the first side edge material 22.

The method may further include inserting a plurality of retention clips 90 into the channel rail 70, each of the retention clips 90 having a pair of clip arms 94, 96. The method may include inserting the glass panel between the clip arms 94, 96. The method may include providing the first side edge material 22 after the cutting of the glass panel support notch 26, such that the first side edge material 22 covers the first notch opening 60. The method may include providing a second one of the panel constructions 10' in an in-line arrangement with the panel construction 10, wherein the second side edge material 24' of the second panel construction 10' directly faces the first side edge material 22 of the panel construction 10. The second side edge material 24' may abut the first side edge material 22. The method may also include providing a second one of the panel constructions 10' in an L-shaped arrangement with the panel construction 10, wherein the first side edge material 22 of the panel construction directly faces the second surface material 16 of the second panel construction 10'. Additional panel constructions 10 can be added to either of these arrangements in an in-line arrangement, an L-shaped arrangement, or another arrangement.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific rails illustrated or described in connection with these embodiments. For example, and without limitation, any individual rail(s) of the described invention may be replaced by alternative rails that provide substantially similar functionality or otherwise provide adequate operation. This includes, for example, presently known alternative rails, such as those that might be currently known to one skilled in the art, and alternative rails that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Features of various embodiments may be used in combination with features from other embodiments. Directional terms, such as "vertical," "horizontal," "top," "bottom," "front," "rear," "upper," "lower," "inner," "inwardly," "outer," "outwardly," "forward," and "rearward" are used to assist in describing the invention based on the orientation of the embodiments shown in the illustrations. The use of directional terms should not be interpreted to limit the invention to any specific orientation(s). Any reference to claim rails in the singular, for example, using the articles "a," "an," "the," or "said," is not to be construed as limiting the rail to the singular.

The embodiments of the invention in which an exclusive property or privilege is claimed are defined as follows:

1. A panel construction comprising:

a core having first and second opposing surfaces, top and bottom edges, and first and second side edges;

a surface material covering the first opposing surface and extending to the top edge;

a side edge material covering the first side edge and extending to the top edge;

a top edge material covering the top edge and extending to the first side edge;

a glass support notch extending through the top edge material and into the top edge of the core, the glass support notch extending through the first side edge of the core, the side edge material on the first side edge extending flush with the first side edge and covering the glass support notch on the first side edge without protruding beyond the first side edge or into the support notch;

a channel rail inserted into the glass support notch, the channel rail having a floor and a pair of sidewalls extending upwardly from the floor; and a glass panel inserted into the channel rail between the sidewalls, with a portion of the glass panel extending above the top edge material.

2. The panel construction of claim 1, wherein the core is formed from a wood fiber material.

3. The panel construction of claim 2, wherein the top edge material is a plastic material.

4. The panel construction of claim 3, wherein the surface material is a laminate.

5. The panel construction of claim 4, wherein the glass support notch extends through the second side edge, the second side edge having a second side edge material covering the glass support notch on the second side edge.

6. The panel construction of claim 5 wherein the channel rail is a U-shaped metal channel.

7. The panel construction of claim 6 including a plurality of clips inserted into the channel rail, each of the clips including a pair of clip arms, the glass panel inserted between the clip arms and held in place by the clip arms.

8. The panel construction of claim 1, wherein the glass panel includes a bottom edge, a top edge, and first and second side edges, and wherein the side edge material includes an inner surface and an outer surface, the first side edge of the glass panel directly facing and adjacent to the inner surface of the side edge material.

9. The panel construction of claim 8 including a second one of the panel constructions adjacent to the panel construction, the side edge material defining a thickness, and wherein the first side edge of the glass panel of the panel construction is spaced from the second panel construction by the thickness of the first side edge material.

10. A panel construction, comprising:

a wood fiber core having first and second surfaces, top and bottom edges, and first and second side edges;

a laminate material covering the first and second surfaces and extending to the top edge of each of the first and second surfaces;

a top edge material covering the top edge;

a first side edge material covering the first side edge and a second side edge material covering the second side edges;

a glass panel support notch cut through the top edge material and into the top edge of the core, the glass panel support notch extending continuously through the wood fiber core from the first side edge to the second side edge and extending through each of the first and second side edges to form a first notch opening on the first side edge and a second notch opening on the second side edge, the first side edge material extending flush with the first side edge and covering the first notch opening without protruding into the first notch opening;

a channel rail disposed in the glass panel support notch, the channel rail having first and second sidewalls; and a glass panel inserted into the channel rail and the glass panel support notch, the glass panel positioned between the sidewalls of the channel rail, the glass panel including a top edge extending outwardly beyond the channel rail and the top edge of the core, the glass panel having first and second side edges, the first side edge directly facing and adjacent to the first side edge material.

11. The panel construction of claim 10 including a plurality of retention clips inserted between the sidewalls of the channel rail, each retention clip having a pair of clip arms, the glass panel inserted between and retained by the clip arms.

12. A method of manufacturing a panel construction, comprising the steps of:

providing a core having first and second opposing surfaces, a top edge, a bottom edge, and first and second side edges;

providing a first surface material on the first surface, including extending the first surface material to the top edge of the first surface;

providing a top edge material on the top edge;

cutting a glass panel support notch in the top edge by cutting through the top edge material, the glass panel support notch extending through the first side edge of the core and forming a first notch opening in the first side edge of the core;

providing a first side edge material on the first side edge of the core, the first side edge material covering the first notch opening;

inserting a channel rail into the glass panel support notch, the channel rail including a floor and a pair of upwardly extending sidewalls; and inserting a glass panel into the channel rail between the sidewalls of the channel rail, the glass panel including a bottom panel edge positioned within the channel rail and below the top edge of the core, the glass panel including a top edge opposite the bottom edge, the top edge of the glass panel extending outwardly beyond the top edge of the core.

13. The method of claim 12 wherein the glass panel includes a first side edge that is adjacent to and directly faces the first side edge material.

14. The method of claim 13 including the step of inserting a plurality of retention clips into the channel rail between the sidewalls, each of the retention clips having a pair of clip arms.

15. The method of claim 14 including inserting the glass panel between the clip arms of the retention clips.

16. The method of claim 12 wherein the first side edge material is provided after the cutting of the glass panel support notch.

17. The method of claim 12 including providing a second one of the panel constructions in an in-line arrangement with the panel construction, wherein the second side edge material of the second panel construction directly faces the first side edge material of the panel construction.

18. The method of claim 17 wherein the first side edge material of the panel construction abuts the second side edge material of the second panel construction.

19. The method of claim 12 including providing a second one of the panel constructions in an L-shaped arrangement with the panel construction, wherein the first side edge material of the panel construction directly faces the first surface material of the second panel construction.

20. The method of claim 19 wherein the first side edge material of the panel construction abuts the first surface material of the second panel construction.

* * * * *